United States Patent [19]

Hemphill et al.

[11] Patent Number: 4,549,836

[45] Date of Patent: Oct. 29, 1985

[54] ICE SLOT CONSTRUCTION

[75] Inventors: Dean P. Hemphill, Houston; Edward H. Phifer, Katy, both of Tex.

[73] Assignee: Shell Oil Company, Houston, Tex.

[21] Appl. No.: 557,494

[22] Filed: Dec. 2, 1983

[51] Int. Cl.[4] ..... E02B 15/02

[52] U.S. Cl. ..... 405/61; 405/217

[58] Field of Search ..... 405/61, 211, 217; 114/40, 42

[56] References Cited

U.S. PATENT DOCUMENTS

| | | | |
|---|---|---|---|
| 3,678,873 | 7/1972 | Bennett | 114/42 |
| 3,693,360 | 9/1972 | Holder | 405/211 |
| 3,791,328 | 2/1974 | Schirtzinger | 114/42 |

FOREIGN PATENT DOCUMENTS

| | | | |
|---|---|---|---|
| 963679 | 3/1975 | Canada | 405/217 |

*Primary Examiner*—David H. Corbin

[57] ABSTRACT

A method and apparatus are provided for forming an ice slot in an ice sheet by cutting discrete blocks of ice in the ice sheet, then gripping the blocks of ice with a claw-like attachment extending from a hydraulic arm and pushing the ice blocks downwardly with the hydraulic arm until the blocks reach a level with the underside of the ice sheet and then rotating the blocks under the surrounding ice sheet, whereby loads on the ice sheet are reduced and the ice blocks contribute to the load capacity of the ice sheet due to the buoyant upward pressure of the ice blocks.

2 Claims, 3 Drawing Figures

ICE SLOT CONSTRUCTION

BACKGROUND OF THE INVENTION

During construction of pipelines, artificial islands, fabricated structures, etc., where operations are carried out from the surface of a floating ice sheet, large amounts of ice must be cut and cleared from the water surface. Often, the weight of the ice removed is such that it must further be removed to some distance away from the opening being formed in the ice in order to avoid overstressing of the ice sheet when work equipment is present. This second handling of removed ice is inconvenient, time consuming, costly and results in the need for additional heavy equipment for the removal operation.

Applicant is not aware of any prior references which, in his judgment as one skilled in the pipeline art, would anticipate or render obvious the novel method and apparatus of the instant invention; however, for purposes of fully developing the background of the invention and establishing the state of the requisite art, the following is set forth: U.S. Pat. Nos. 4,373,836; 4,205,928; 4,129,011; 4,126,013; 4,094,149; 4,053,406; 3,977,345 and 3,950,955.

SUMMARY OF THE INVENTION

The primary purpose of the present invention is to provide a method and apparatus for forming an ice slot in an ice sheet floating on water, by a technique which effectively eliminates the loads that would otherwise be imposed by the ice removed from the slot and which may also strengthen the sides of the ice slot, which method and apparatus are relatively convenient and economical to use, which are not time consuming and which do not require the need for additional heavy equipment for the removal of ice, and which do not subject the ice to dangerous stresses. The ice sheet is first severed to form the dimensions of the ice slot, and then the ice slot is cleared of ice by pushing the ice which is severed under the ice sheet adjacent to the ice slot, whereby the buoyancy of the severed ice strengthens the sides of the ice slot. Preferably, the ice slot is formed by cutting discrete blocks of ice in the ice sheet, gripping the blocks of ice with a claw-like attachment extending from a hydraulic arm and then pushing the ice blocks downwardly with the hydraulic arm and under the surrounding ice sheet. More preferably, the ice blocks are rotated as they are pushed downwardly into position under the surrounding ice sheet.

Other purposes, distinctions over the art, advantages and features of the invention will be apparent to one skilled in the art upon review of the following:

DESCRIPTION OF PREFERRED EMBODIMENTS

Figure 3:
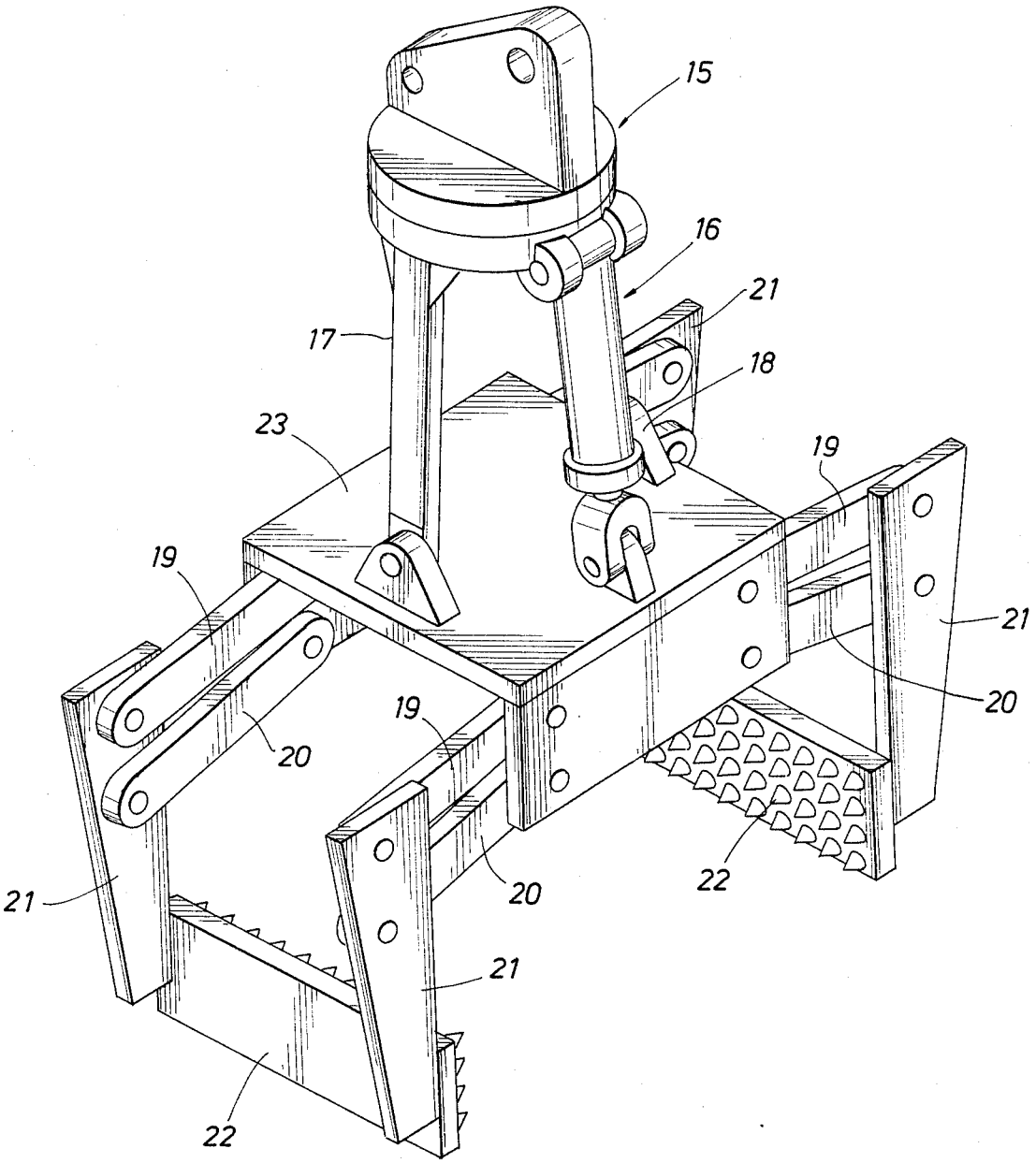
FIG. 3 provides a more detailed view of the ice block gripping mechanism of the present invention.

The present invention pertains to an apparatus and method for constructing ice slots in an ice sheet. Preferably, the ice is cut into convenient sized blocks to form the ice slot by a cutting device, for example a Ditch Witch TM with a chain/bar cutter. Other severing means may be used: rotary or reciprocating saws; band saws; bucket wheel trenchers; for instance. The present invention requires that the ice, after being severed into convenient sized pieces, be submerged in place and then forced underneath the adjacent ice sheet. A relatively small hydraulic excavator is preferred for this operation, preferably equipped with a claw-like attachment, that exerts a downward force followed by a lateral or tilting force to force each block (or segment) of ice under the ice sheet to the side of the ice slot. Where a narrow, i.e., single block width slot is required, a single downward force applied off-center may be sufficient to cause a block to move or even to rotate under the sheet. When a wide slot is being prepared, preferably a gripping attachment is utilized which improves the ability to position the block and force it into place. A preferred apparatus is a standard backhoe bucket or an articulated attachment to replace the bucket, which has a claw-like attachment. A special purpose claw assembly having a rotational capability in both horizontal and vertical planes is most preferred for use with the invention as is shown in FIG. 3 hereof.

The present invention enjoys numerous advantages over the prior art. Thus, it is no longer necessary to provide large, heavy lifting equipment for the removal of ice masses that may weigh several tons in air. Additionally, the vertical force requirement to submerge a block of floating ice is only about 10 percent of the vertical lift required to raise the same unit volume onto the ice sheet. Further, a clear work area results, providing access for equipment for construction. Deflection and flexural stress in the ice sheet is reduced, and a second handling of the ice is thereby avoided. Finally, the buoyant force of the ice under the ice sheet further reduces the deflection of the ice sheet under loading from construction equipment.

Having thus generally described the apparatus and method of the present invention, as well as its numerous advantages over the art, the following is a detailed description thereof, given in accordance with specific reference to the drawings.

Figure 1:
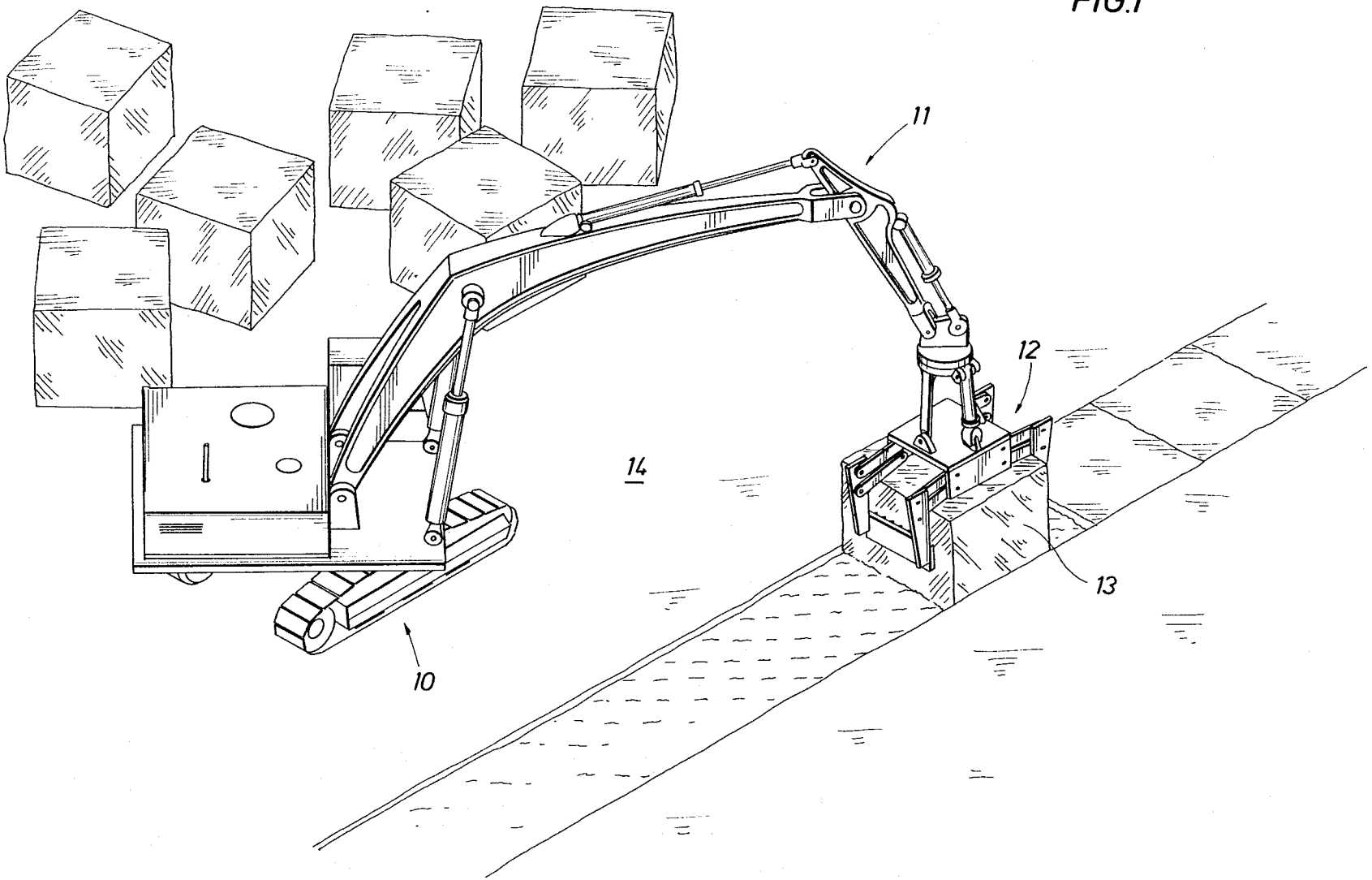
FIG. 1 shows lifting ice blocks from the water to form an ice slot and stacking the blocks to one side of the ice slot.

FIG. 1 shows a backhoe 10 equipped with a hydraulic arm 11 and a claw-like device 12 at the end of the hydraulic arm which may be used to remove blocks of ice 13 from an ice sheet 14 and deposit the blocks of ice to one side of the ice sheet. While the claw-like attachment 12 of the present invention is highly useful for this purpose, it is more desirable in accordance with the invention to submerge the blocks of ice and place them under the ice sheet, which enjoys several advantages as above discussed.

Figure 2:
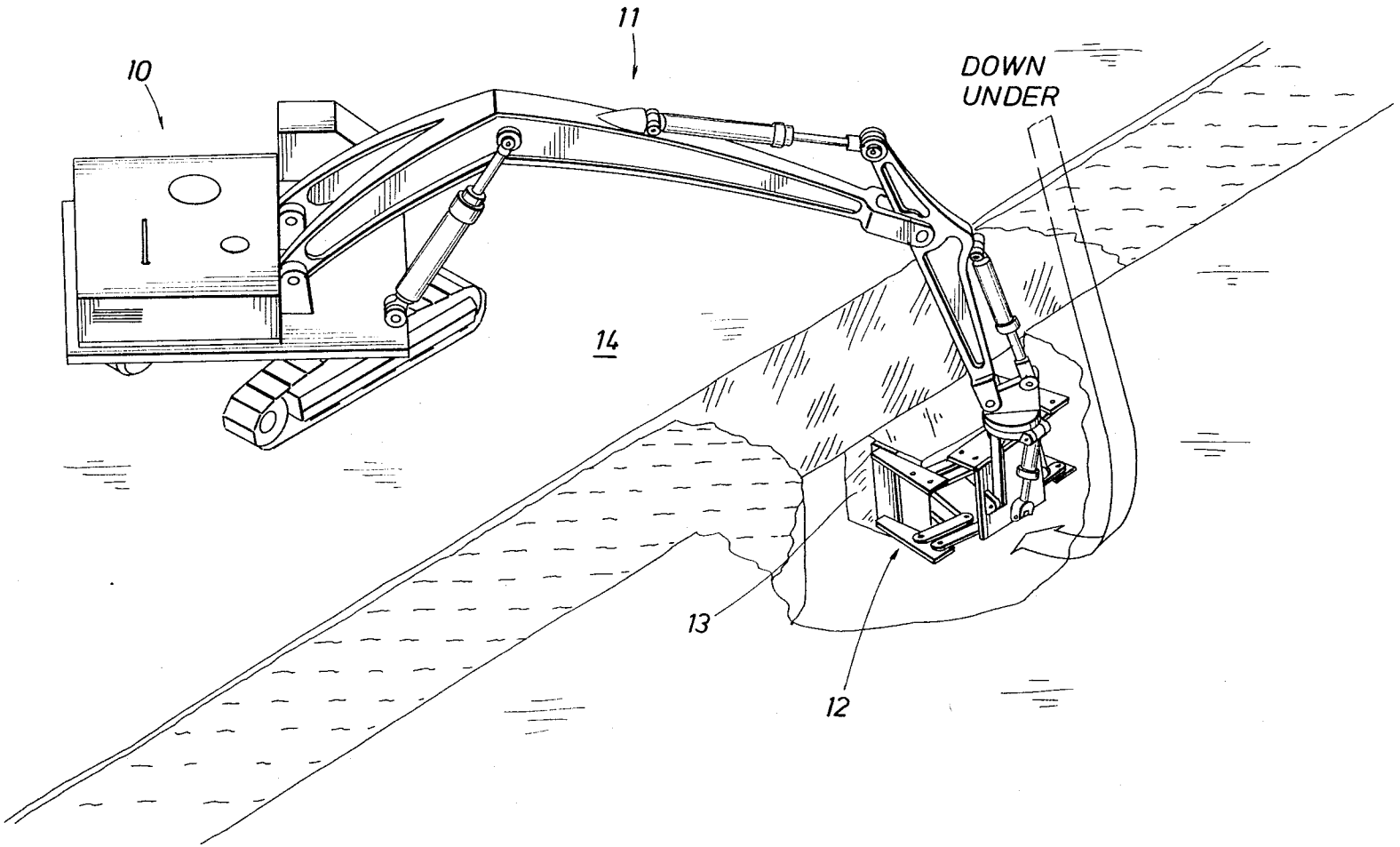
FIG. 2 shows pushing the ice blocks downwardly and under the ice sheet.

FIG. 2 shows the use of the backhoe 10 in accordance with the present invention wherein the hydraulic arm 11 and claw-like attachment 12 are used to force the block of ice 13 downwardly and even more preferably, to rotate the block of ice and insert it under the ice sheet 14. This is an especially advantageous technique, even where the ice sheet is very thick, inasmuch as the hydraulic arm 11 can reach well down into the ice sheet, for example as much as twenty feet. In addition, as above noted, once the ice blocks are installed under the edge of the ice sheet, they add considerable strength to the ice sheet, especially after the blocks of ice have effectively welded into the ice sheet and increased its thickness at the lips of the ice slot. Of particular value is the horizontal rotation capability of the attachment, which allows the claw to be oriented with the ice block no matter what the relative alignment of the machine itself may be; thus reducing maneuvering time and allowing the operator to assume the most attractive position while remaining away from the edge of the ice slot.

FIG. 3 provides a more detailed view of the claw-like attachment of the present invention. The hydraulic arm 11 of the backhoe 10 is attached to the claw-like extension via a universal joint 15 which allows the claw means to be controllably rotated in a horizontal plane. A hydraulic extension 16 along with two fixed arms 17 and 18 allow the claw-like device to be tilted or rotated in a vertical plane. This permits rotating the ice block under the ice sheet. These arms are attached to a platform structure 19 from which levers 19 and 20 are attached to each of four legs 21 which, in turn, are attached to a claw means 22 which grips the ice. The claw means 22 may be hydraulically actuated (not visible in the Figure) so as to grip the ice block securely. The levers 19 and 20 may also be arranged such that when the claw-like member is raised, the claws 22 press inwardly, gripping the block of ice. The heavier the ice block, the more gripping force results from the lifting operation.

The foregoing description of the invention is merely intended to be explanatory thereof, and various changes in the details of the described method and apparatus may be made within the scope of the appended claims without departing from the spirit of the invention.

What is claimed is:

1. A method for forming an ice slot in an ice sheet floating on water, comprising:

cutting discrete blocks of ice;

gripping the ice blocks with a claw-like attachment to a hydraulic arm held by means supported on the ice sheet; and pushing the ice blocks downward and under the surrounding ice sheet, the claw-like attachment being utilized to rotate the ice blocks as the ice blocks are pushed under the surrounding ice sheet.

2. An apparatus for forming an ice slot in an ice sheet floating on water comprising:

means for severing the ice sheet to form the ice slot, thereby leaving ice in the ice slot; and means for gripping the ice in the ice slot with a claw-like attachment to a hydraulic arm and rotating the ice in the ice slot down and under the surrounding ice sheet.

* * * * *